US005227580A

United States Patent [19]

Berville et al.

[11] Patent Number: 5,227,580

[45] Date of Patent: Jul. 13, 1993

[54] SEALING DEVICE FOR AN ARROW PROJECTILE

[75] Inventors: Marc P. Berville; Joel M. Leblond, both of Bourges, France

[73] Assignee: Giat Industries, France

[21] Appl. No.: 953,286

[22] Filed: Sep. 30, 1992

Related U.S. Application Data

[63] Continuation of Ser. No. 685,052, Apr. 15, 1991, abandoned.

[30] Foreign Application Priority Data

May 4, 1990 [FR] France ..... 90 05676

[51] Int. Cl.[5] ..... F42B 14/06

[52] U.S. Cl. ..... 102/521

[58] Field of Search ..... 102/520-524, 102/703, 532

[56] References Cited

U.S. PATENT DOCUMENTS

| | | | |
|---|---|---|---|
| H265 | 5/1987 | Bonde et al. | 102/521 |
| 3,620,167 | 11/1971 | Romer et al. | 102/521 |
| 4,187,783 | 2/1980 | Campoli et al. | 102/521 |
| 4,424,748 | 1/1984 | Schiff | 102/523 |
| 4,444,113 | 4/1984 | Campoli | 102/521 |
| 4,487,131 | 12/1984 | Luther | 102/523 |
| 4,901,646 | 2/1990 | Feldmann et al. | 102/521 |
| 4,941,244 | 7/1990 | Ortmann et al. | 102/521 |

FOREIGN PATENT DOCUMENTS

| | | | |
|---|---|---|---|
| 183892 | 6/1986 | European Pat. Off. | 102/520 |
| 3332675 | 3/1985 | Fed. Rep. of Germany | 102/521 |

*Primary Examiner*—Harold Tudor

*Attorney, Agent, or Firm*—Parkhurst, Wendel & Rossi

[57] ABSTRACT

A saboted projectile for ensuring gas tight sealing of a threaded penetrator with its sabot having a tapping. This sealing device is formed of an elastomer element applied on the rear portion of the sabot and comprises a lip in resilient abutment on the penetrator and is obtained by molding over the sabot having an insert engaged therein.

4 Claims, 3 Drawing Sheets

SEALING DEVICE FOR AN ARROW PROJECTILE

This is a continuation of application Ser. No. 07/685,052 filed Apr. 15, 1991, now abandoned.

BACKGROUND OF THE INVENTION

1. Field of the Invention

The technical sector of the present invention is that of arrow projectiles comprising a penetrator and a sabot and in particular means providing sealing between the sabot and the penetrator.

When firing an arrow projectile, it is important that the propulsive gases do not infiltrate towards the front of the projectile, for they may cause damage or opening of the sabot at the rear, which may be harmful to the mechanical strength of the projectile. Defective sealing would automatically cause a loss of initial speed of the projectile and impair accuracy.

Attempts have therefore been made, using different means, to overcome this kind of drawback.

2. Description of the Prior Art

EP 0 183 892 describes a molded elastomer sealing means, formed by a ring fast with radial arms. The ring takes up a position in a channel common to the sabot and to the penetrator, the arms being imprisoned in grooves formed at the level of the joint planes of the different elements of the sabot. The grooves open into the channel of the belt which thus completes sealing of the system. This approach is a variant of a prior method, known to one skilled in the art, which consists of injecting elastomer into these same grooves and channel.

This technique has the following drawbacks:

the channels and the grooves must necessarily be machined, which involves additional manufacturing costs, the tolerances in machining the channels and grooves must be tight, and similarly molding of the sealing means must be particularly carefully done, among other things so as to be free of burrs, the gases may infiltrate into the joint planes upstream of the sealing means, tending to open the sabot from the rear, thus reducing the efficiency of the seal, especially in the case of the molded seal, injection of the elastomer into the grooves may generate bubbles, which cannot be detected subsequently and cause a sealing rupture.

It is clear from the foregoing that it is advantageous to form the seal directly on the rear face of the sabot, such a process not requiring machining of the channels and grooves and also providing easy visual control.

The document STATUTORY INVENTION USH 265 describes a process which consists in spraying a silicone elastomer on the rear part of the sabot as well as on a part of the penetrator adjacent the sabot. The zones to be sprayed are defined by masks. The drawback of this method is that it requires a diluted elastomer to be sprayed, which is therefore very fluid and able to infiltrate into the different elements of the sabot between the penetrator and said sabot. The result is that it may, in an uncontrolled way, serve as link between these different components (since the elastomer has adhesive properties) and consequently cause dissymmetric opening of the sabot, which may result in disturbances of the external ballistics.

EP 0 306 615 relates to a method which consists, using a specially designed tool, of molding a sealing film over the rear of the sabot. An O-seal prevents the sealing agent from penetrating between the sabot and the projectile. Thus, the above mentioned drawbacks are avoided. Nevertheless, the sealing must be provided on a complete projectile, i.e. in which penetrator and sabot are assembled together (the same goes for the other above mentioned methods). After opening, residue of elastomer may remain which is adhered to the rear of the penetrator and which may disturb the external ballistics.

This forms a drawback to the extent that it is sometimes technically and economically advantageous to manufacture the sabots in one production unit and the penetrators in another (e.g., sub-contracting). In view of confidentiality concerns, penetrators are at the present time the subject of numerous studies and may, from this point of view, be termed sensitive products.

Furthermore, constraints related to working safety and hygiene may arise because sometimes heavy metals are used (e.g., uranium) and sometimes pyrotechnic elements (tracers or destabilizing devices in exercise projectiles for example). Therefore, it is desirable to avoid handling the penetrators as much as possible.

The above factors contribute the desirability of providing a final sabot/penetrator assembly as late as possible during manufacture of the projectile.

The patent DE 3 332 675 describes a rear seal for arrow projectiles which has one or more lips bearing on a bar. The seal also comprises an insert, made from metal or the like, on which the resilient material of the seal is vulcanized. The seal is then fixed to the shoe by screwing or by bonding.

In order to avoid gas leaks it is necessary to form such a seal with extremely accurate manufacturing tolerances so as to ensure perfect fitting together of the rear face of the sabot and the seal.

Such tolerances, as well as the machining operations made necessary by the presence of the fixing screws, result in an increase in the manufacturing cost of the projectile.

Finally, fixing of this seal by bonding risks being unreliable.

SUMMARY OF THE INVENTION

An object of the present invention is to provide sealing means for subsequent sabot and penetrator assembly, while providing perfect sealing without adherence between the seal and the penetrator.

Another object of the present invention is to provide a method of forming the seal which avoids mechanical assembly of the seal on the sabot.

The sealing device of the present invention does not involve the presence of elastomer residues on the penetrator, such residues disturbing the trajectory of the penetrator.

The present invention provides a device ensuring gas-tight seal of an arrow projectile, the sealing provided between a sabot having a tapping and a threaded penetrator mounted in the tapping characterized by an elastomer element applied on a rear portion of the sabot and comprising a lip in resilient abutment on the penetrator and in that the elastomer element is obtained by molding over the sabot having an insert engaged within the sabot.

An elastomer ring may partially fill the profile of the tapping of the sabot.

Longitunal grooves may be disposed in the tapping at the level of the joint planes of the sabot, these grooves being filled with the elastomer element.

The elastomer element may have a Shore hardness greater than or equal to 70 and elongation before rupture less than or equal to 250%.

The lip of the elastomer element may have an edge of a thickness H between 10 and 15% of the diameter of the penetrator.

The invention also provides a method of manufacturing a sealing device, characterized in that:

an insert having a threaded cylindrical portion is screwed into the tapping of the sabot and a smooth truncated cone-shaped or cylindrical portion projecting at the rear of the sabot, an elastomer material is molded partially over the insert in the form of a lip and over the rear portion of the sabot, in a mold, vulcanization is carried out in the mold so as to obtain the elastomer element, the insert is removed and the penetrator is subsequently positioned within the sabot.

The length of the cylindrical portion of the insert is substantially greater than or equal to the diameter of the penetrator.

The truncated cone-shaped portion may have an angle at the apex between 6° and 10° and a length greater than or equal to the diameter of the penetrator.

The cylindrical threaded portion of the insert may have a manufacturing tolerance between the mean tolerance and the material minimum of the thread of the penetrator.

A result of the present invention resides in the fact that sealing is obtained, at the rear portion of the sabot, by deformation of the elastomer lip and resilient abutment thereof on the penetrator.

Another result resides in that the pressure of the propulsive gases for increases the contact of the elastomer element on the penetrator.

Another result resides in the absence of tearing residues adhering to the penetrator, which is a source of disturbance of the trajectory.

BRIEF DESCRIPTION OF THE DRAWINGS

Other advantages will be better understood from the complement of description given hereafter by way of example, with reference to the accompanying figures in which.

DESCRIPTION OF THE PREFERRED EMBODIMENTS

Figure 1:
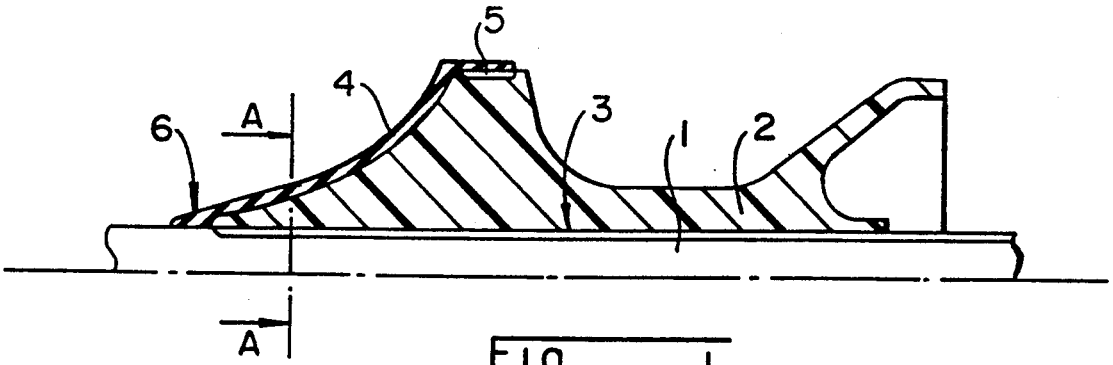
FIG. 1 is a partial cross section of an arrow projectile showing the final assembly.

An arrow projectile comprises, as shown in FIG. 1, a penetrator 1 made for example from uranium, equipped with a sabot 2. The sabot and the penetrator are linked in a known way by a threaded portion 3. The rear portion of the sabot carries an elastomer element 4 which extends from penetrator 1 to the belt 5 of the sabot. The elastomer element 4 comprises a lip 6 in resilient abutment on the penetrator 1.

Thus, the elastomer element does not adhere to the penetrator and sealingly remains in abutment thereto at the moment of sabot penetrator separation. The diameter of the cylindrical rear portion of the penetrator (on which lip 6 bears) is slightly less than the diameter of the threaded portion, which allows the penetrator to be screwed in the sabot by introducing the penetrator through the front part of the sabot.

Thus, lip 6 is not damaged by the threaded portion and it is resiliently deformed so as to be applied on the cylindrical rear portion of the penetrator.

Figure 2:
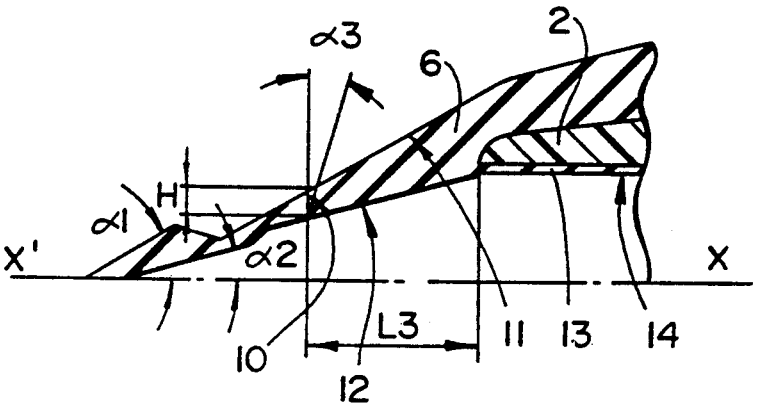
FIGS. 2 and 2*a* are enlarged cross sections of the lip of the elastomer element.

FIG. 2 shows an enlarged view of lip 6, shown at rest, i.e. with the penetrator removed.

This lip has a length L3 projected on the axis X'X of the projectile greater than or equal to the outer diameter of the penetrator, an edge 10 of thickness H between 10% and 15% of the diameter of the penetrator and whose end wall defines, with respect to a perpendicular to the axis X'X, an angle $\alpha 3$ of about 15°. The external surface 11 of lip 6 defines with axis X'X an angle $\alpha 1$ less than or equal to 30° and the internal surface 12 an angle $\alpha 2$ between 4° and 25°.

The elastomer penetrates into the tapping 14 of the sabot and partially covers the threads thereof.

The thickness and length of the elastomer ring 13 are shown schematically in FIG. 2.

Figure 2A:
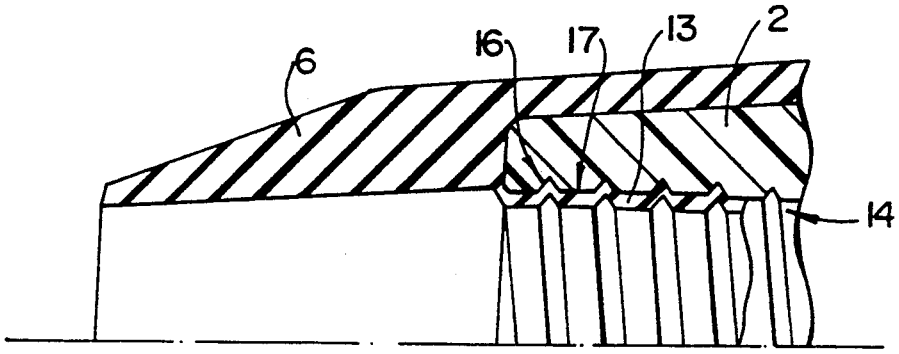

FIG. 2*a* shows the profile of the tapping 14, the sides 16 and top 17 of the threads are covered with an elastomer layer of a few tenths of a millimeter (0.2 to 0.5 mm) thick.

The total axial length of ring 13 is about 2 to 10 times the length of the pitch of the thread (i.e., for a pitch of 4 mm: a length of 8 to 40 mm), and it is interrupted irregularly because of the manufacturing method described below.

Such an arrangement improves sealing. In fact, the elastomer ring will be compressed by the penetrator when positioned in the sabot, any gaps between penetrator and sabot will be completely filled by the elastomer element, without adherence between penetrator and sabot. The elastomer ring 13 will therefore improve sealing without disturbing the separation of the sabot and the penetrator.

Seal 4, lip 6 and ring 13 are preferably obtained by vulcanization. The particular manufacturing method proposed by the invention will be described hereafter.

Concerning the elastomer, it will have to have the following mechanical characteristics: Shore hardness $\geqq 70$ and elongation before rupture $\leqq 250\%$. Furthermore, the vulcanization conditions must not exceed 135° C. for 20 minutes so as not to cause post-curing of the sabot (generally made from 7049 A according to the US standard MIL). A polymer vulcanizable at high temperature (from 120° to 135° C.) may for example be used. The product sold under the trademark ALCANSYL 538, a hot-vulcanizing silicone elastomer, and commercialized by the firm SAFIC ALKAN gives good results.

Moreover, the elastomer must adhere perfectly to the sabot and to the material of the belt, over the whole contact area. For this, it is advisable to coat the surfaces of the sabot with an adhering agent. The nature of this product will be defined as a function of the elastomer, and comes within the field of know-how of one skilled in the art of the over-molding operation.

By way of example, for the above mentioned elastomer, the adhering agent sold under the trademark THIXON 305, primary adhesive for silicone elastomer, and commercialized by WHITTAKER CORPORATION has given satisfaction.

The elastomer element is obtained in the following way.

Figure 3:
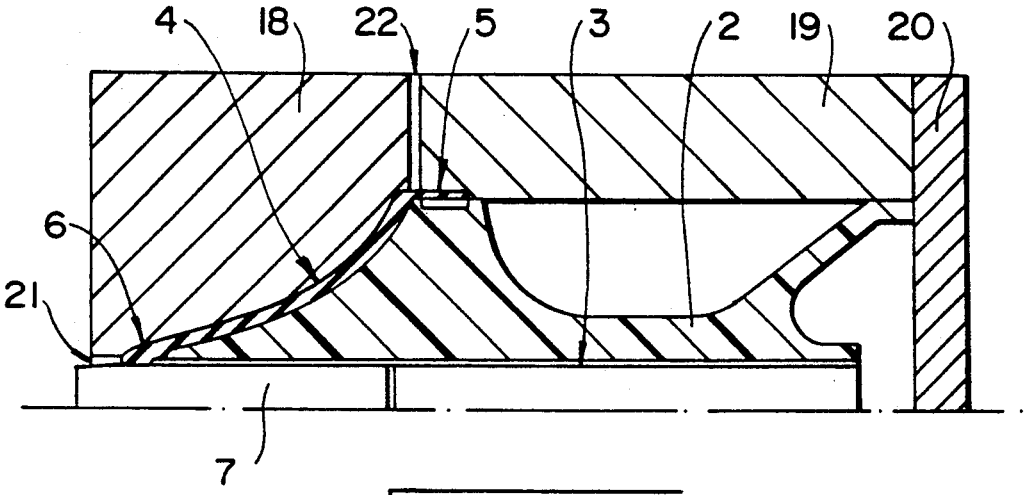
FIG. 3 is a partial cross section of the sabot disposed in the mold and showing the positioning of the insert.

FIG. 3 shows one step of the manufacturing method where the penetrator is replaced by an insert 7 for forming the over-molding.

The mold in which the vulcanization takes place is not shown in detail, it matches the rear shape of the sabot 2 while providing the space required for forming the seal.

It comprises a piece 19 on which is fixed a bottom 20, for example by means of screws, and which receives the sabot. A piece 18 is fixed to piece 19 by known means, not shown, such as screws or flanges.

Piece 18 has one or preferably more injection orifices 21, and one or more radial orifices 22 for discharging air during injection.

This insert 7 is subsequently removed for positioning the penetrator 1. The profile of lip 6 at the level of the penetrator must be such that the pressure of the propulsive gases of the projectile tends to apply (compress) said lip 6 on the penetrator 1. Clamping of this lip 6 on penetrator must also be provided. For this, in order to provide clamping which is as homogeneous as possible, considering the external profile of the sabot 2 and that of the over-molding which is derived therefrom, insert 7 must have a conicity in line with lip 6.

Figure 4:
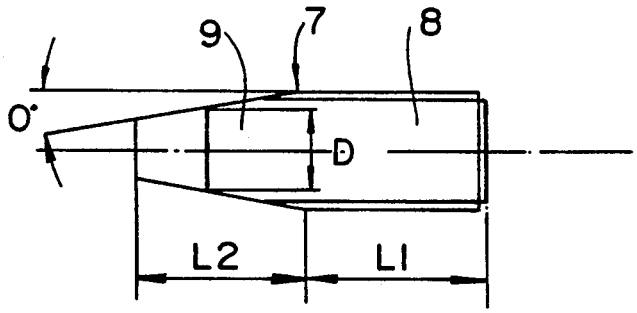
FIG. 4 is a view of the insert.

FIG. 4 shows insert 7 alone, formed of a cylindrical threaded portion 8 and a truncated cone-shaped portion 9. Portion 8 has a nominal external diameter identical to that of penetrator 1 and a length L1 greater than or equal to the outer diameter, namely 10 to 20 times the pitch of the threaded portion. Portion 9 has a length L2 at least equal to the width of lip 6 which it is desired to obtain, and an angle at the apex between 6° and 10° and a diameter D, in line with the end of the lip, equal to 8% to 13% of the outer diameter of portion 8. The threaded part of the insert has a profile identical to that of the penetrator, but the manufacturing tolerance of the threaded portion is preferably between the mean tolerance and the material minimum of the threaded portion of the penetrator.

Material minimum is defined by the minimum diameter of the threaded portion of the penetrator (minimum tolerance). The mean tolerance is the mean arithmetical value between the maximum and minimum values of the diameter of the threaded portion of the penetrator.

Thus, by way of example, for a penetrator having a thread diameter at the top of a tooth equal to 25 mm ±0.1 mm an insert will be chosen having a thread diameter at the top of a tooth of 25 mm(+0, −0.1 mm).

Thus, a clearance is provided between the insert and the sabot which allows the slight penetration of the elastomer between the thread of the insert and the tapping 14 of the sabot. After removal of the insert, ring 13 of elastomer remains partially filling the profile of the thread 14 and being interrupted irregularly.

This ring improves gas tightness.

The choice of the length L1 of the insert greater than or equal to the diameter of the penetrator is important for it creates a travel distance of the elastomer during molding such that it does not extend beyond the insert and does not fill the whole tapping of the sabot.

In the case where portion 9 is cylindrical, its diameter will be chosen equal to 8% to 13% of the diameter of portion 8.

As was mentioned above, the elastomer must adhere perfectly to the sabot and to the material of the belt, over the whole contact area. On the other hand, it importantly must not remain stuck (adhered) to the insert so as not to cause damage during removal from the mold. For this, the surfaces concerned should be coated with appropriate products, namely an adhering agent for the sabot and a stripping agent for the insert. The nature of these products will be defined as a function of the elastomer, and forms part of the know-how of a man skilled in the art charged with the over-molding operation. By way of example, for the above mentioned elastomer, the adhering agent sold under the trademark THIXON 305 primary adhesive, and commercialized by WHITTAKER CORPORATION and the stripping agent sold under the trademark SIPIOL C have given satisfaction.

The invention provides undeniable advantages which are:

no tearing residues (random geometry) on the penetrator following the phase of releasing the sub-projectile during firing, which residues, because of their geometry and combustion, could alter the trajectory of an arrow shell fired at high speed (≧1650 m/s) and at a great distance (≧2000 m), more flexible manufacture, allowing the vulcanization to be sub-contracted and avoiding acquiring considerable means in machines and tooling for a single type of manufacture, minimal handling of the penetrator, advantageous for hygiene and safety reasons (i.e., may present toxic or pyrotechnic risks), preservation of the confidentiality attached to certain manufactures, removal of the penetrator possible for a minimum cost for replacement thereof by another generation of penetrators or for molding on another sabot.

To implement the method according to the invention, the following is the procedure:

the insert 7 is screwed into sabot 2 so as to cause the truncated cone-shaped portion 9 to appear, the sabot thus equipped is placed in a mold having an internal profile conforming to the external profile of element 4, the elastomer material is injected so as to obtain the elastomer element 4 by vulcanization, insert 7 is removed, the penetrator is subsequently positioned within the sabot.

The insert may be positioned either at the front or else at the rear of the sabot: similarly, it may be removed after vulcanization through the front of the sabot which has the advantage of not causing the threaded portion of the insert to pass over lip 6.

However, it may be preferred to remove the insert through the rear so as to reduce the unscrewing time: that will be possible provided that deformation of the lip caused by passage of the threaded portion of the insert remains a resilient deformation, i.e. less than 250% with the elastomer proposed in accordance with the invention.

These conditions are fulfilled in most cases and in particular with the lip dimensions given above. The penetrator will be positioned through the front of the sabot so as to avoid turning the lip back with the risk of tearing it.

Figure 5:
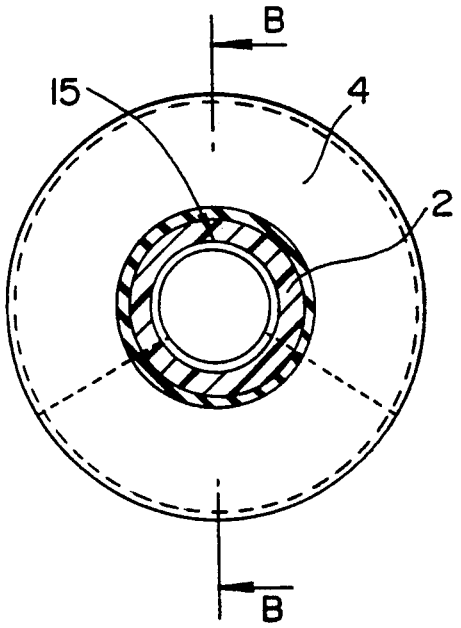
FIGS. 5 and 6 illustrate a variant of construction of the elastomer element associated with a particular sabot.
Figure 6:
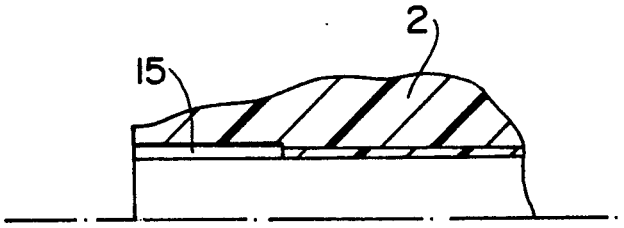

FIGS. 5 and 6 illustrate a modification in which the sabot has longitudinal grooves 15 disposed at the level of the joint planes of the different sectors of the sabot. These grooves will have a length less than or equal to a fraction of L3 and a depth of about 1 mm.

The elastomer penetrates into the grooves as it penetrates between the insert and the sabot to form the ring 13 during over-molding. The adhering agent will have been previously deposited in the grooves and will ensure holding of the elastomer on the material forming the sabot at this level. The advantage of such a configuration is that it improves the mechanical strength of lip 6 relative to the sabot by giving it additional points of adherence to the sabot at the level of the tapping and improves sealing at the level of the joint planes of the segments of the sabot.

What is claimed is:

1. A saboted projectile, comprising:

a sabot having a tapping comprising internal threads;

a threaded penetrator disposed at least partially within said sabot such that threads of said threaded penetrator engage the tapping of said sabot; and an elastomeric seal adhered onto a rear portion of said sabot, said elastomeric seal comprising a lip rearwardly extending from said sabot and a ring axially extending into the internal threads of the tapping of said sabot, said lip and said ring being formed as one-piece with said elastomeric seal, said lip being in gas-tight abutment with a circumferential rear portion of said threaded penetrator, wherein no bonding is present between said lip and said threaded penetrator, and no bonding is present between said ring and said threaded penetrator.

2. The device of claim 1, further comprising longitudinal grooves in the tapping of said sabot at an inner rear portion thereof, wherein the material of said elastomeric seal extends into said longitudinal grooves and is formed as one-piece with elastomeric seal.

3. The device of claim 1, wherein the elastomeric seal has a Shore hardness greater than or equal to 70 and elongation of not more than 250% before rupture.

4. The device of claim 1, wherein an edge of said lip has a thickness H between 10 and 15% of a diameter of the penetrator.

* * * * *